United States Patent [19]

Ishii et al.

[11] 4,308,741

[45] Jan. 5, 1982

[54] APPARATUS FOR CHANGING ROLLS OF VERTICAL ROLLING MILL STAND

[75] Inventors: Hikonori Ishii; Kenichi Ide, both of Yokohama, Japan

[73] Assignee: Ishikawajima-Harima Jukogyo Kabushiki Kaisha, Tokyo, Japan

[21] Appl. No.: 109,795

[22] Filed: Jan. 7, 1980

[30] Foreign Application Priority Data

Feb. 27, 1979 [JP] Japan ..... 54/22155

[51] Int. Cl.[3] ..... B21B 31/08

[52] U.S. Cl. ..... 72/239

[58] Field of Search ..... 72/239, 238

[56] References Cited

U.S. PATENT DOCUMENTS 2,752,804 7/1956 Kalberkamp ..... 72/239

3,670,587 6/1972 Lemper ..... 72/239

*Primary Examiner*—Milton S. Mehr

*Attorney, Agent, or Firm*—Alfred E. Miller

[57] ABSTRACT

An apparatus for changing the rolls of a vertical rolling mill stand by moving each roll of a roll pair to the roll changing position transversely outwardly of the rolling position where the spacing between the rolls is maximum and then pulling upwardly the roll together with its upper and lower bearing boxes from a housing. The rolls may be changed even when a slab is passing.

2 Claims, 8 Drawing Figures

APPARATUS FOR CHANGING ROLLS OF VERTICAL ROLLING MILL STAND

BACKGROUND OF THE INVENTION

The present invention relates to an apparatus for changing the rolls of a vertical rolling mill stand.

In general, an installation for continuous casting of slabs has low productivity due to its low casting speed. In order to improve productivity, a slab with an extremely large cross section (of the thickness of 280 to 300 mm and of the width of 1800 to 2000 mm) must be cast. However, the slab with such a large cross section must be decreased in cross section before it enters a hot strip mill (which produces coils of strip with the width ranging in general from 800 to 1500 mm). In order to attain such high reduction ratios, a sizing mill consisting of vertical and horizontal rolling mill stands is employed.

The present invention is directed to an apparatus for changing the rolls of the vertical rolling mill stands in the sizing mill or of other vertical rolling mill stands.

The vertical rolling mill stands use in general caliber rolls. Because of their constructions and their difference in peripheral speeds, they wear very rapidly so that they must be replaced with new rolls almost every few days.

When the continuous casting of slabs is interrupted whenever the caliber rolls are changed, it is impossible to improve productivity. It follows therefore that the roll replacements must be made without interrupting the continuous casting operations.

The conventional apparatus for changing the rolls are such that each roll is replaced by a crane with a C-shaped hook or the like at the line center so that the rolls cannot be replaced when a slab is passing the rolling mill stand. As a result, the slab which is continuously cast must bypass the vertical rolling mill stand when the rolls are being replaced in order to prevent the decrease in productivity. To this end, an additional bypass line must be provided, which is the waste of money.

The primary object of the present invention is therefore to provide an apparatus which may permit the replacement of the rolls of a vertical rolling mill stand even when a slab is passing therethrough.

Another object of the present invention is to eliminate both the space on the ground for storing new rolls and the additional line bypassing the rolling mill stand.

A further object of the present invention is to provide an apparatus which may be remote controlled in changing the rolls of a vertical rolling mill stand.

The present invention will become more apparent from the following description of the preferred embodiments thereof taken in conjuction with the accompanying drawings.

DETAILED DESCRIPTION OF THE PREFERRED EMBODIMENTS

Figure 2:
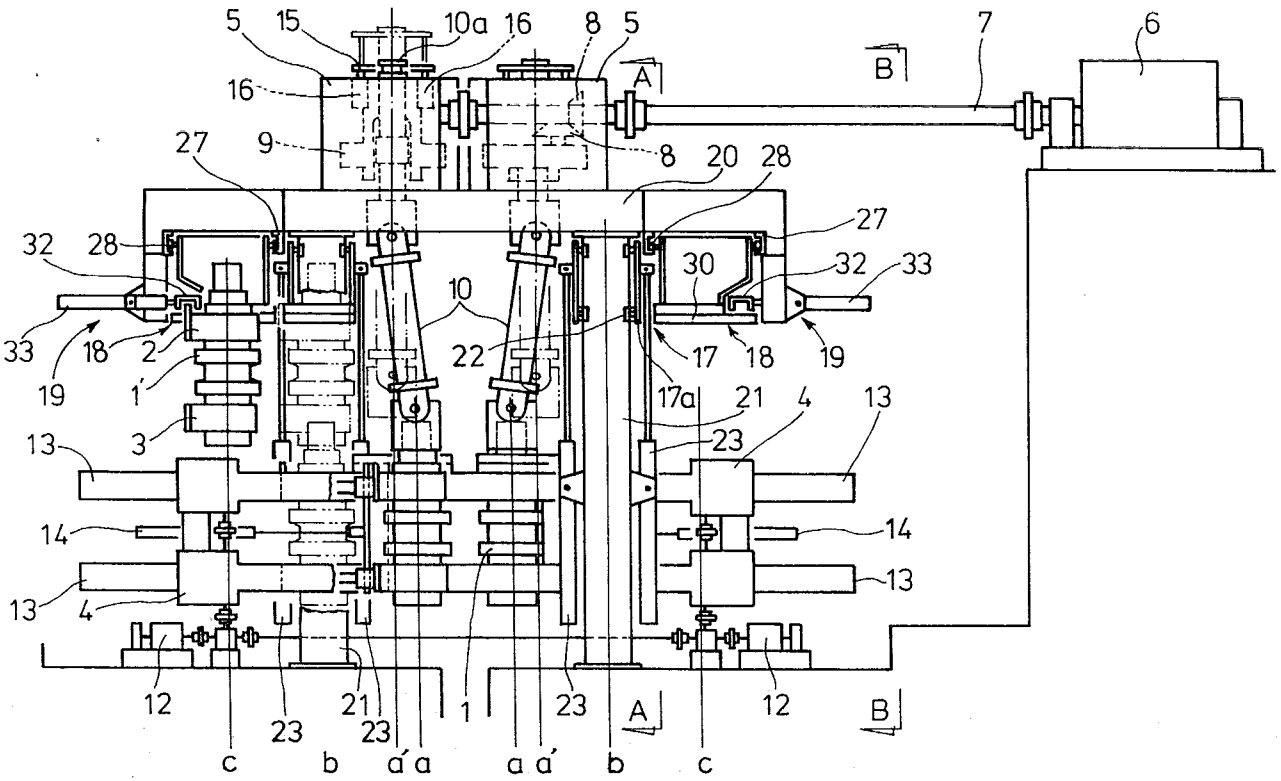
FIG. 2 is a front view thereof.
Figure 3:
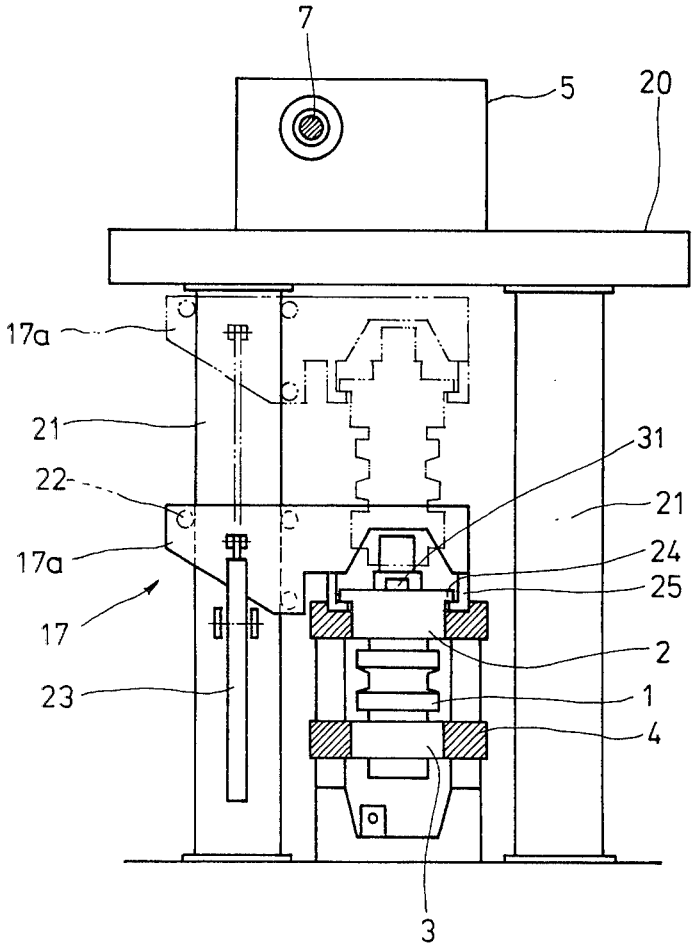
FIG. 3 is a side view taken in the direction of the arrow A—A of FIG. 2.
Figure 4:
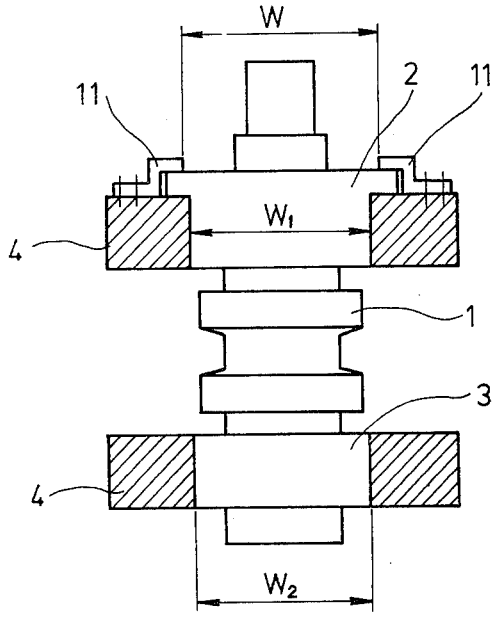
FIG. 4 is a diagrammatic view illustrating the relationship between the housing and bearing boxes at the roll changing position.

A vertical rolling mill stand with a roll changing system in accordance with the present invention has a pair of right and left caliber rolls 1 each of which, as best shown in FIGS. 3 and 4, is supported by a housing 4 through upper and lower bearing boxes 2 and 3. One end of a spindle 10 is removably pivoted to the upper end of each of the rolls 1 while the upper or other end is pivoted to the shaft of a gear 9 in a gear casing 5 which in turn is in mesh with a bevel gear 8 carried by a power transmission shaft 7 coupled to a main motor 6, whereby the caliber rolls 1 may be rotated as best shown in FIG. 2.

Roll gap adjusting screws 13 extended outwardly to right and left from the housing 4 are drivingly coupled to roll gap adjusting motors 12 as shown in FIG. 2 so that the spacing between the pair of caliber rolls 1 may be suitably adjusted.

The bearing boxes 2 and 3 are over-balanced outwardly of a slab by a hydraulic cylinder 14 mounted on the housing 4 so that when the roll gap adjusting screws 13 are retracted the spacing between the caliber rolls 1 may be automatically increased by the overbalance. The pair of caliber rolls 1 may be retracted from the widest gap positions during rolling indicated by a to the roll changing positions indicated by b by the roll gap adjusting screws 13.

Referring to FIG. 2, the spindles 10 become upright at the positions indicated by a'. The upper end **10*a* of the shaft in connection with the spindle 10 is made into sliding engagement with a lift beam 15 having its both ends pivoted to hydraulic cylinders 16 mounted on the gear casing 5. The caliber rolls 1 may be moved between the positions a where the spacing between the rolls during rolling is maximum and the positions b where the caliber rolls 1** are changed.

Figure 5:
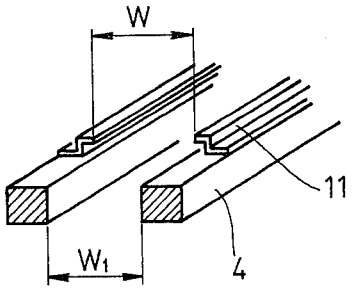
FIG. 5 is a fragmentary perspective view of the housing at the roll changing position.

As best shown in FIGS. 4 and 5, at the roll changing position b, the width $W_1$ of the upper opening of the housing 4 is made greater than the width $W_2$ of the roll bearing box 3 so that the caliber roll 1 may be pulled upwards. But at the rolling position, flanges 24 of the upper bearing box 2 engage with chock clamps 11 on the housing 4 so that the caliber roll 1 may be moved only widthwise. At the roll changing positions b are arranged the devices for pulling the caliber rolls 1 together with the roll bearing boxes 2 and 3 upwardly of the housing 4. W is the width between the chock clamps 11 when the caliber rolls 1 are at rolling positions.

When the rolls 1 are changed, the hydraulic cylinders 16 are extended to lift the lift beam 15 at the position a' so that the spindles 10 are disconnected from the caliber rolls 1. Thereafter the roll gap adjusting screws 13 are retracted so that the caliber rolls 1 are moved widthwise along the chock clamps 11 towards the roll changing positions b. At the roll changing position b, the width $W_1$ of the opening of the housing 4 is greater than the width $W_2$ of the bearing box 3 and the chock clamps 11 are not extended as best shown in FIG. 5 so that the caliber roll 1 together with the bearing boxes 2 and 3 may be pulled upwardly of the housing. Thereafter a new caliber roll 1 with the upper and lower bearing boxes 2 and 3 is lowered and fitted into the housing 4. Thus the caliber roll 1 may be changed.

The device for changing the caliber roll 1 in the manner described above is installed at the roll changing position b. The roll changing device comprises a roll lifting mechanism 17, a roll carriage 18 and a roll transfer mechanism 19 (See FIGS. 3, 6 and 7).

The roll lifting mechanism 17 is in line with the transverse axis X—X (See FIG. 1) of the rolling mill stand at the position b for lifting the old roll 1 together with its upper and lower bearing boxes 2 and 3 or lowering a new roll together with its upper and lower bearing boxes 2 and 3. As best shown in FIGS. 2 and 3, at the roll changing position b, columns 21 are erected which supports an upper deck or stand 20 upon which are mounted the gear casings 5. Wheels 22 of a lifting frame 17*a* ride on rails on the column 21 and the upper end of the piston rod of a cylinder 23 mounted vertically on the column 21 is pivoted to the lifting frame 17*a*. Therefore as the hydraulic cylinders 23 are extended or retracted, the lifting frame 17*a* is lifted or lowered along the rails on the column 21. The lifting frame 17*a* is equipped with a suspension device 25 which comprises a pair of L-shaped plates (See FIG. 3) depending from the lifting frame 17*a*. The L-shaped plates are spaced apart from each other by such a distance that the horizontal portions may snugly engage with the outwardly extended flanges 24 of the upper bearing box 2, whereby the caliber roll 1 together with its upper and lower bearing boxes 2 and 3 may be suspended from the lifting frame 17*a* and traversed along the suspension device 25.

The carriage 18 is adapted to move in parallel with the rolling line. That is, as best shown in FIGS. 1, 2, 6 and 7, wheels 28 of the carriage 18 ride on parallel horizontal guide rails 27 attached to the undersurface of the upper stand 20 in parallel with the rolling line and outwardly of the columns 21 (See FIG. 2). The carriage 18 is equipped with a pair of suspension devices 30 each of which is substantially similar in construction to the suspension device 25 of the lifting frame 17*a* and which engages with the flanges 24 of the upper bearing box 2. The carriage 18 is drivingly connected to a cylinder 29 so that as the cylinder 29 is extended or retracted the carriage 18 may be moved along the guide rails 27. When the carriage 18 is in line with the transverse axis X—X (See FIG. 1), the caliber roll assembly (consisting of the caliber roll 1 and its upper and lower bearing boxes 2 and 3) may be transferred from the lifting frame 17*a* to the carriage 18 or vice versa as will be described in more detail below.

The transfer of the caliber roll assembly between the lifting frame 17*a* and the carriage 18 is made by the transfer mechanism 19. As best shown in FIGS. 2 and 7, the transfer mechanism 19 is equipped with an engaging member 32 which is adapted for engagement with a mating engaging member 31 at the top of the upper bearing box 2 (See FIG. 6) and is carried at the end of the piston rod of a hydraulic cylinder 33. Therefore as the hydraulic cylinder 33 is extended or retracted, the engaging member 32 may be extended or retracted transversely at right angles to the rolling line (See FIG. 7). As best shown in FIG. 2, when the caliber roll assembly which is suspended from the carriage 18 is moved in parallel with the rolling line at the position c, the engaging member 32 is so retracted that it will not engage with the engaging member 31 of the upper bearing box 2.

Next the mode of operation for changing the caliber rolls 1 will be described. As described elsewhere, the old caliber roll assembly is disconnected from the spindle 10 at the position a' where the spindle 10 becomes upright. Thereafter the caliber roll assembly is moved to the roll changing position b where the lifting frame 17*a* of the roll lift mechanism 17 has been already lowered in such a way that the suspension device 25 may engage with the flanges 24 of the upper bearing box 2 of the caliber roll 1 as shown in FIG. 3. Therefore when the caliber roll assembly reaches the roll changing position b, the flanges 24 of the upper bearing box 2 automatically engage with the suspension device 25 of the lifting frame 17*a*.

Figure 1:
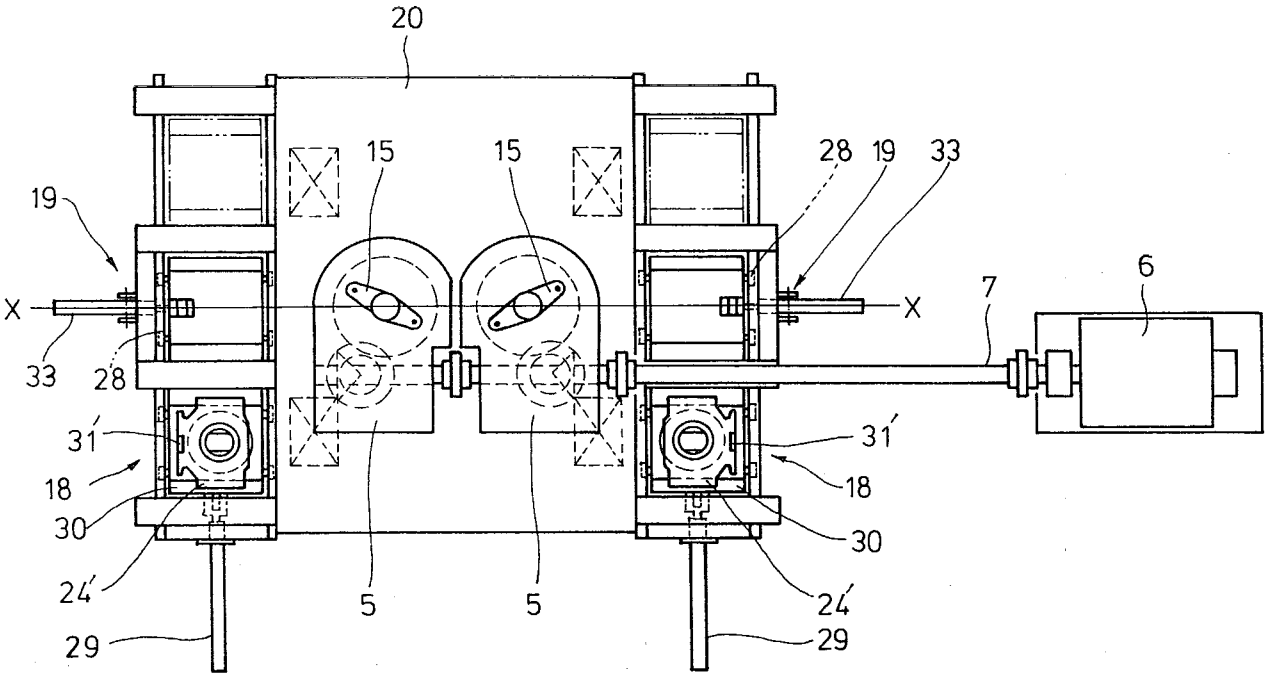
FIG. 1 is a top view of a vertical rolling mill stand incorporating a roll changing apparatus in accordance with the present invention.
Figure 6:
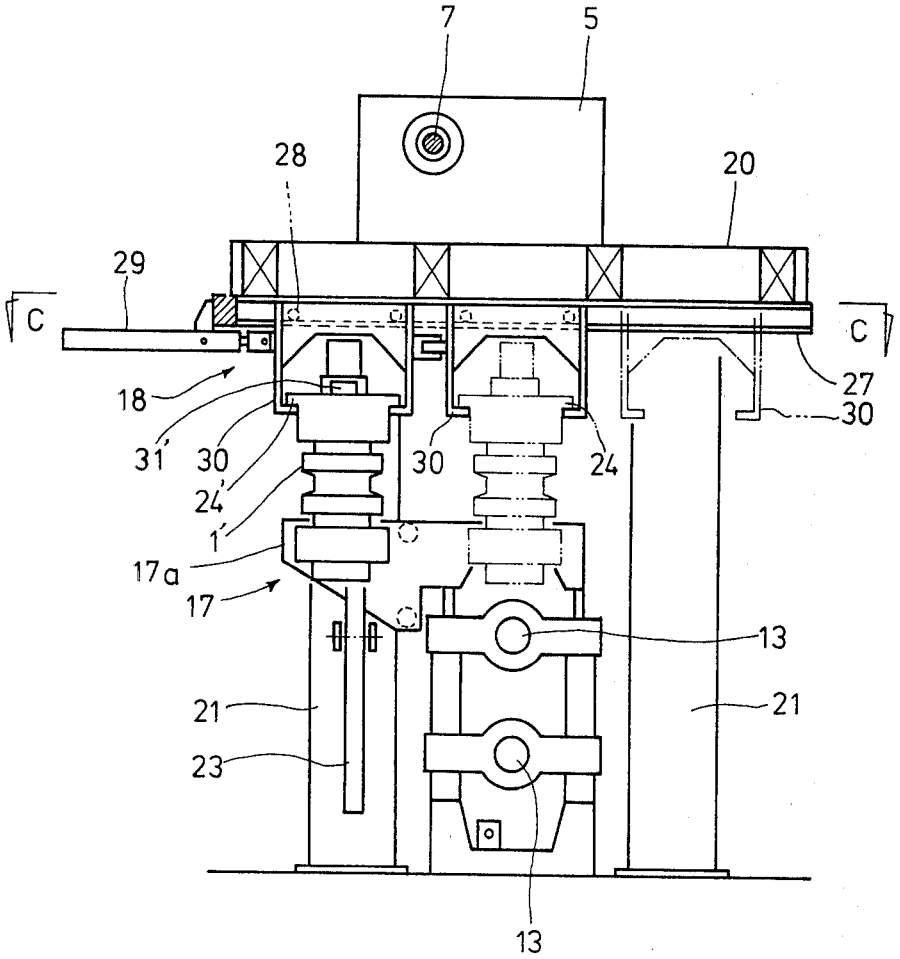
FIG. 6 is a side view looking in the direction of the arrows B—B of FIG. 2.
Figure 7:
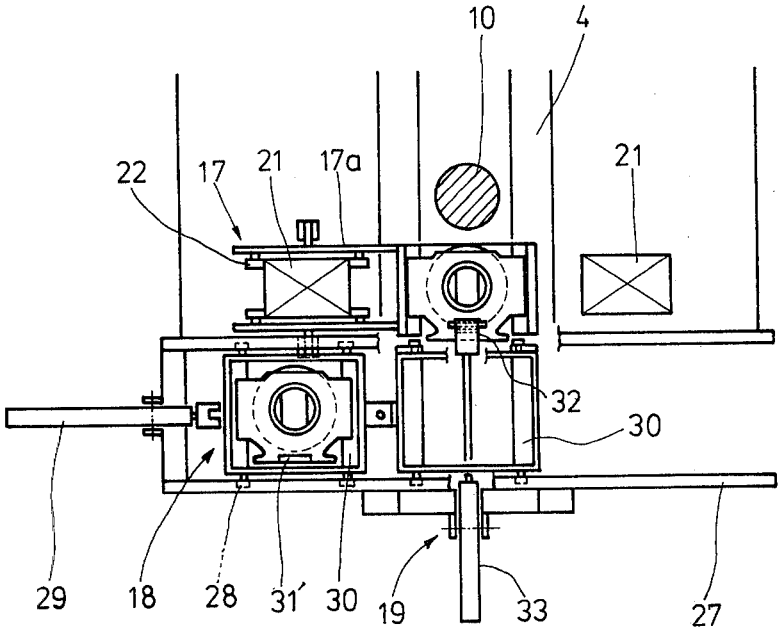
FIG. 7 is a fragmentary top view looking in the direction of the arrows C—C of FIG. 6

One of the pair of suspension devices 30 of the carriage 18 suspends a new caliber roll assembly 1' as best shown in FIGS. 6 and 7 and the carriage 18 is so moved that the other suspension device 30 (suspending no caliber roll assembly) may be in line with the transverse axis X—X (See FIG. 1).

After the flanges 24 of the upper bearing box 2 of the old caliber roll assembly has engaged with the suspension device 25 of the lifting frame 17*a*, the cylinder 23 is extended so that the lifting frame 17*a* is lifted and consequently the caliber roll assembly is pulled upwardly of the housing 4 and lifted.

Since the hydraulic cylinder 33 is extended so that the engaging member 32 is extended to the operative position for engagement with the engaging member 31 of the upper bearing box 2, the engaging member 32 automatically engages with the mating engaging member 31 as the caliber roll assembly is lifted by the lifting frame 17*a*. At the transfer position, the hydraulic cylinder 33 is retracted so that the caliber roll assembly is moved along the suspension device 25 and transferred to the other suspension device of the carriage 18.

Thereafter the hydraulic cylinder 29 is actuated so that the carriage 18 is moved in parallel with the rolling line in such a way that said one suspension device 30 suspending the new caliber roll assembly 1' may be brought to the transfer position. As the carriage 18 is moved, the engaging member 32 of the transfer mechanism 19 is automatically released from the mating engaging member 31 of the bearing box 2 of the old roll assembly and automatically engages with the engaging member 31' of the bearing box 2 of the new caliber roll assembly 1'.

The hydraulic cylinder 33 is extended so that the new caliber roll assembly 1' is transferred from the other suspension device 30 to the suspension device 25 of the lifting frame 17*a*. Next the lifting frame 17*a* is lowered so that the new caliber roll assembly 1' is lowered and fitted into the housing 4.

The roll gap adjusting screws 13 are driven so that the new caliber roll assembly 1' may be moved from the roll changing position to the operative position. Thus the old caliber roll assembly is replaced with the new caliber roll assembly.

The removed caliber roll assembly is lifted by a crane or the like from the carriage 18 and moved to a roll shop where the old caliber roll 1 is repaired. The repaired caliber roll is suspended from the carriage 18 for replacement.

Figure 8:
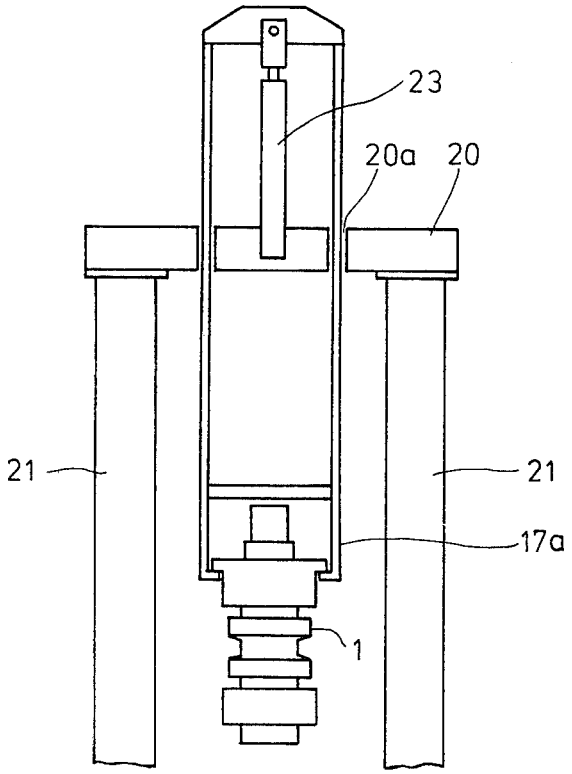
FIG. 8 is a schematic view showing a modification of the roll lift mechanism shown in FIG. 3.

So far the lifting frame 17*a* has been described as being lifted and lowered along the columns 21, but it is to be understood that it may be lifted and lowered along the columns or posts erected on the housing 4. Alternatively, as shown in FIG. 8, the power cylinder 23 may be mounted on the upper stand 20 so that the lifting frame 17*a* may be lifted and lowered through the guide openings 20*a* formed through the upper deck 20.

Instead of the pair of suspension devices 30, the carriage 18 may have more than two suspension devices or a plurality of carriages each having a suspension devices 30 may be arranged.

Reversals of the movements of the carriage 18, the lifting frame 17*a*, and the transfer mechanism 19 may be made automatically in response to the signals from for example limit switches or the like.

Instead of the power cylinder, the carriage 18 may be driven by a belt drive or may be of the self-propelled type. In the latter case, the guide rails 27 may be extended to the roll shop. Furthermore, instead of moving straight along the rolling line, the carriage 18 may be so arranged as to rotate in such a way that its suspension devices 30 may be alternately brought to the transfer position.

The effects, features and advantages of the present invention may be summarized as follows:

(1) The caliber roll assembly is once moved transversely outwardly and then lifted so that even when the roll assembly is being changed, it is not necessary to interrupt the continuous casting operation. As a result, the productivity of continuous casting may be considerably improved.

(2) Because of the reason (1), it is not necessary to bypass a continuous slab so that a bypass line may be eliminated and consequently the installation cost may be considerably reduced.

(3) Since the roll assemblies are replaced over the rolling mill stand, the arrangements of equipment and machines on the ground level may be freely selected. Furthermore the space for storing new roll assemblies may be eliminated.

(4) Since the special roll changing apparatus is used, the safe and reliable roll changing operations may be ensured.

(5) Because of the reason (4), the roll changing operations may be made within a short time interval.

(6) The remote control of the roll changing apparatus is possible so that the safety in roll changing operations may be further improved.

What is claimed is:

1. In a roll changing apparatus for a vertical rolling mill stand, wherein a roll gap adjusting system includes means for moving the rolls to a roll change position beyond a given maximum gap adjusting position, the rolls being removable from the mill stand in said roll change position said roll having an upper bearing means provided with an outwardly projecting flange; the improvement comprising: a roll lifting arrangement including a pair of L-shaped plates with horizontal portions adapted to engage said outwardly projecting flange of the upper bearing means of a roll when the roll is moved to said roll change position, guide rails, carriage means movable parallel to the rolling direction of said mill stand on said guide rails, said carriage means having support means with horizontal portions shaped to support a roll at the flange of the upper bearing means thereof, said carriage being movable to a position with the support means thereof aligned with the said roll lifting means, said carriage being above rolls in said roll changing position whereby said lifting means is adapted to move rolls vertically from said roll change position to horizontal alignment with the support means of said carriage means, and further comprising a transfer mechanism for transferring rolls between the support means of said carriage and lifting means when the support means of said lifting means is horizontally aligned with the support means of said carriage means, said transfer mechanism comprising engaging means adapted to engage means on the upper bearing means of said roll for moving said roll horizontally.

2. The roll changing apparatus of claim 1, wherein the engaging means of said transfer mechanism comprises a member having a U-shaped cross section with the underneath thereof open, and said upper bearing means of said roll having means thereon shaped to be engaged by said U-shaped engaging member.

* * * * *